US006483036B1

(12) United States Patent
Santoyo

(10) Patent No.: US 6,483,036 B1
(45) Date of Patent: Nov. 19, 2002

(54) ARRANGEMENT FOR SPACING ELECTROWINNING ELECTRODES

(75) Inventor: Manuel G. Santoyo, Tucson, AZ (US)

(73) Assignee: Quadna, Inc., Tucson, AZ (US)

( * ) Notice: Subject to any disclaimer, the term of this patent is extended or adjusted under 35 U.S.C. 154(b) by 0 days.

(21) Appl. No.: 10/135,749

(22) Filed: Apr. 30, 2002

Related U.S. Application Data

(63) Continuation-in-part of application No. 09/765,156, filed on Jan. 16, 2001, now abandoned.

(51) Int. Cl.[7] ..... H01B 7/12
(52) U.S. Cl. ..... 174/146; 205/80
(58) Field of Search ..... 174/67, 146, 146 H, 174/138 E, 138 G, 142, 149 R, 168; 205/80; 248/58, 65

(56) References Cited

U.S. PATENT DOCUMENTS 3,579,431 A * 5/1971 Jasberg ..... 204/278.5
3,701,726 A * 10/1972 Laboue ..... 204/222
3,997,421 A * 12/1976 Perri et al. ..... 204/267
4,184,930 A * 1/1980 Appleby et al. ..... 204/252
4,619,751 A * 10/1986 Robinson ..... 204/267
4,622,111 A * 11/1986 Brown et al. ..... 204/245
4,679,526 A * 7/1987 Dziedzic ..... 118/503
5,002,642 A * 3/1991 Kaneko et al. ..... 204/198
5,051,157 A * 9/1991 O'Brien et al. ..... 204/279
5,476,578 A * 12/1995 Forand et al. ..... 204/207
5,599,431 A * 2/1997 Scorpio ..... 204/279
5,762,776 A * 6/1998 Alexander et al. ..... 204/267
6,284,109 B1 * 9/2001 Ebert ..... 204/279

* cited by examiner

*Primary Examiner*—Dean A. Reichard
*Assistant Examiner*—Jinhee Lee
(74) *Attorney, Agent, or Firm*—Antonio R. Durando; Durando Birdwell & Janke, PLC

(57) ABSTRACT

An arrangement for spacing electrodes used in the electrowinning of copper includes two identical spacers which are designed to be mounted in an opening of an anode. Each spacer is elongated and has two ends which respectively face upward and downward during use. The upward facing end includes a confining surface which confronts a major surface of the anode on which the spacer is mounted and a sliding surface which faces away from the confining surface and has a slope. The confining surface and the sliding surface meet at a knife-edge which again faces upward during use. When the anode on which the spacer is mounted is immersed in an electrolytic bath and a cathode is lowered into a position adjacent to the anode, the knife-edge prevents the cathode from becoming caught on the spacer should the cathode be lowered onto the spacer. In addition, the sliding surface allows the cathode to slide towards its position. The two spacers have cooperating parts at their downward facing ends for locking the spacers to one another.

27 Claims, 3 Drawing Sheets

ARRANGEMENT FOR SPACING ELECTROWINNING ELECTRODES

REFERENCE TO RELATED APPLICATION

This application is a continuation-in-part of application Ser. No. 09/765,156, now abandoned, filed Jan. 16, 2001 by Manuel G. Santoyo for "Arrangement for Spacing Electrowinning Electrodes".

BACKGROUND OF THE INVENTION

1. Field of the Invention

The invention relates to an arrangement for spacing electrodes used in electrolytic processes.

2. Description of the Prior Art

In the electrowinning of copper, anodes and cathodes are suspended side-by-side in a processing tank with anodes and cathodes alternating. The tank contains an electrolytic bath, and copper is deposited on the major faces of the cathodes in the form of sheets. The sheets are stripped from the cathodes once they have achieved a predetermined thickness.

A separation must be maintained between an anode and its neighboring cathodes as well as between an anode and an adjoining wall of the processing tank. To this end, a hole is drilled in each anode. A threaded shaft carrying a button at one end is passed through the hole in the respective anode so that the button comes into contact with one of the major surfaces of the anode. Subsequently, a second button with a threaded passage is screwed onto the shaft and comes to rest against the opposite major surface of the anode. Each of the buttons is nonconductive and lies between the anode and a neighboring cathode or between the anode and a wall of the processing tank.

The cathodes are removed from the tank in order to strip the copper sheets from them. Following stripping of the copper sheets, the cathodes are reinserted in the tank. On occasion, a cathode is lowered onto one of the buttons mounted on the adjoining anodes. When this happens, the button can shear off.

Another difficulty with the buttons is that they reduce the amount of current reaching the areas of the cathodes directly opposite the buttons. This decreases the amount of copper deposited in these areas and leads to shadowing.

U.S. Pat. No. 4,619,751 addresses these difficulties. This patent discloses a spacer which is designed to slide on the header bar of an anode. The spacer has a length which exceeds the height of the anode, and the spacer includes two cylindrical legs which sit on opposite sides of the anode. The lower ends of the legs are joined to one another by a U-shaped part or a pin which passes underneath the anode while the upper ends of the legs are joined to each other by an inverted V-shaped part which passes over the header bar. The inverted V-shape of the upper part of the spacer reduces the likelihood of a cathode catching on the spacer as the cathode is lowered into position next to the anode. Moreover, the cathode can slide along the sloping surfaces of the inverted V-shaped part of the spacer to facilitate lowering of the cathode. Finally, the cylindrical shape of the spacer legs reduces the contact area between a leg and an adjoining cathode.

The spacer of the above patent operates satisfactorily. However, as mentioned previously, the spacer has a length which exceeds the height of an anode. Consequently, the spacer is rather large and unwieldy.

SUMMARY OF THE INVENTION

It is an object of the invention to provide a spacing arrangement for electrodes which is relatively easy to handle.

The preceding object, as well as others which will become apparent as the description proceeds, are achieved by the invention.

One aspect of the invention resides in an arrangement for spacing electrodes.

One embodiment of the arrangement comprises at least one electrode having a first side, an opposite second side and an opening extending between the first side and the second side. This embodiment of the arrangement further comprises at least one spacer passing through the opening in the electrode. The spacer has an upper end provided with a confining part which is at least partially disposed on the first side of the electrode, and the spacer also includes a spacing part which is at least partially disposed on the second side of the electrode to separate the latter from a neighboring electrode. The confining part has a first surface portion which faces one side of the electrode, an upward facing second surface portion and an upward facing edge which bridges the first surface portion and the second surface portion. The edge at least approximates a knife-edge, and the second surface portion has a slope to permit sliding of an electrode along the second surface portion.

The preceding embodiment of the spacing arrangement includes a spacer which can be mounted in an opening of an electrode. Since such an opening can be formed at a location below the upper end of the electrode, it is not necessary for the spacer to extend along the full height of the electrode. This allows the size of the spacer to be reduced and handling of the spacer to be simplified.

Due to the fact that the upward facing edge of the confining part of the spacer at least approximates a knife-edge, an electrode lowered onto the spacer is highly unlikely to become hung up on the edge and cause the spacer to shear. Thus, the area of the edge will generally be too small for an electrode to catch on the edge. Furthermore, since the upward facing second surface portion adjoining the upward facing edge of the confining part has a slope, an electrode lowered onto the second surface portion can slide so that there is little likelihood of the lowered electrode being hung up by the second surface portion.

Another embodiment of the arrangement comprises a first spacer adapted to be mounted on a selected electrode of a plurality of electrodes and a second spacer adapted to be mounted on the selected electrode. The first spacer defines a first space while the second spacer, which is discrete from the first spacer, defines a second space. The first spacer and the second spacer are arranged with a portion of the first spacer in the second space and a portion of the second spacer in the first space.

The present embodiment of the spacing arrangement includes two distinct spacers which are adapted to be mounted on an electrode. The spacers have cooperating portions which make it possible to assemble the two spacers so that they can function as a single spacer. Since the two spacers are distinct, however, each of these spacers can be smaller than such a single spacer thereby allowing the two spacers to be manipulated with relative ease.

An additional aspect of the invention resides in a method of arranging for the spacing of electrodes.

One embodiment of the method comprises the steps of providing at least one electrode having a first side, an opposite second side and an opening extending between the first side and the second side, and providing a spacer having a spacing part and an end which includes a confining part. The confining part has a first surface portion, a second surface portion and an edge which bridges the first surface portion and the second surface portion. Such edge at least approximates a knife-edge, and the second surface portion has a slope. This embodiment of the method further comprises the step of passing the spacer through the opening in the electrode so that the confining part is at least partially disposed on the first side of the electrode and the spacing part is at least partially disposed on the second side of the electrode. The instant embodiment of the method also comprises the step of positioning the spacer with the first surface portion facing the first side of the electrode and with the second surface portion and the knife-edge facing upward. The current embodiment of the method additionally comprises the steps of immersing the electrode and the spacer in an electrolytic bath, and immersing an additional electrode in the electrolytic bath such that the spacing part is disposed between the electrodes.

Another embodiment of the method comprises the steps of providing a first spacer which defines a first space and is adapted to be mounted on a selected electrode of a plurality of electrodes, and providing a discrete second spacer which defines a second space and is adapted to be mounted on the selected electrode. This embodiment of the method further comprises the step of positioning the first spacer and the second spacer with a portion of the first spacer in the second space and with a portion of the second spacer in the first space.

Additional features and advantages of the invention will be forthcoming from the following detailed description of preferred embodiments when read in conjunction with the accompanying drawings.

DESCRIPTION OF THE PREFERRED EMBODIMENTS

Figure 1:
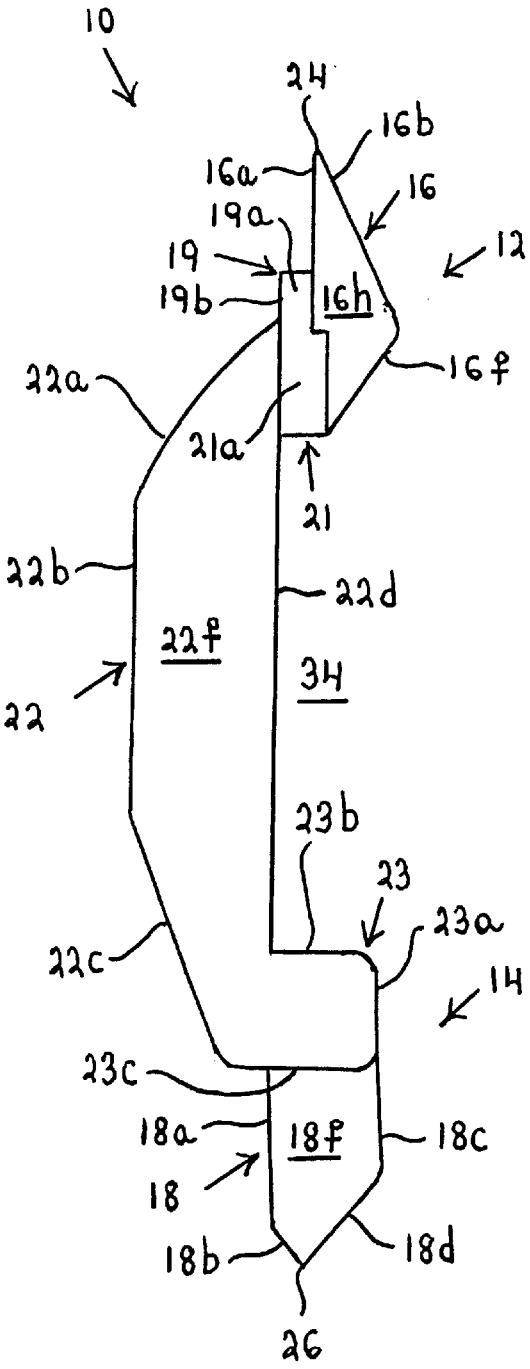
FIG. 1 is a view of one side of a spacer in accordance with the invention.
Figure 2:
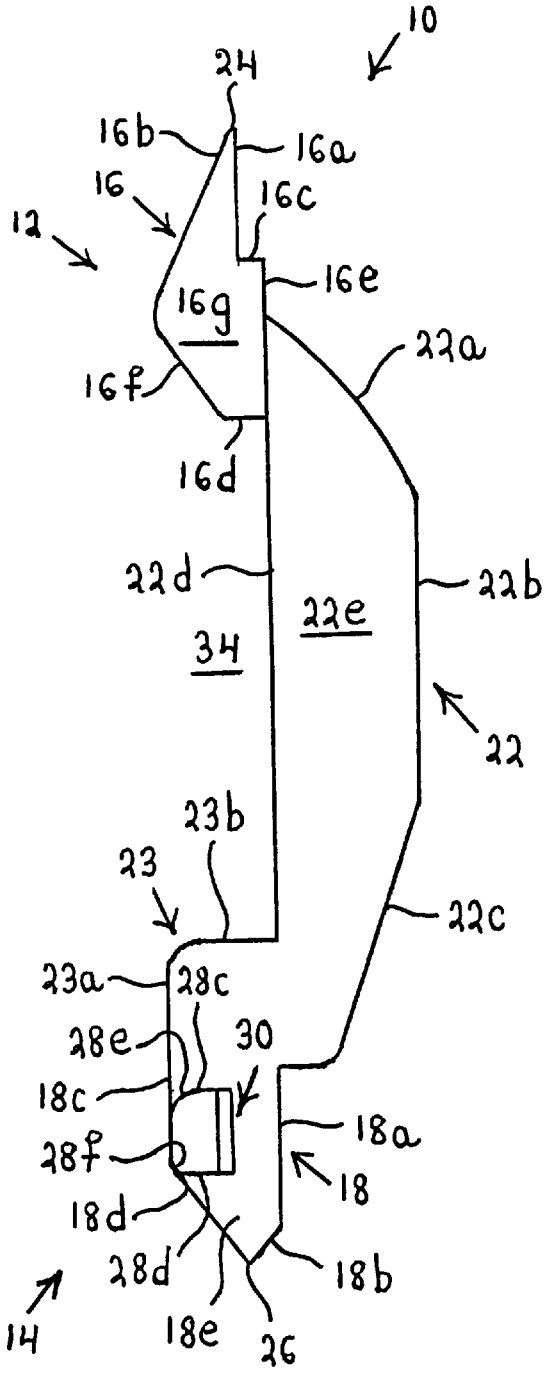
FIG. 2 is a view of the opposite side of the spacer of FIG. 1.
Figure 3:
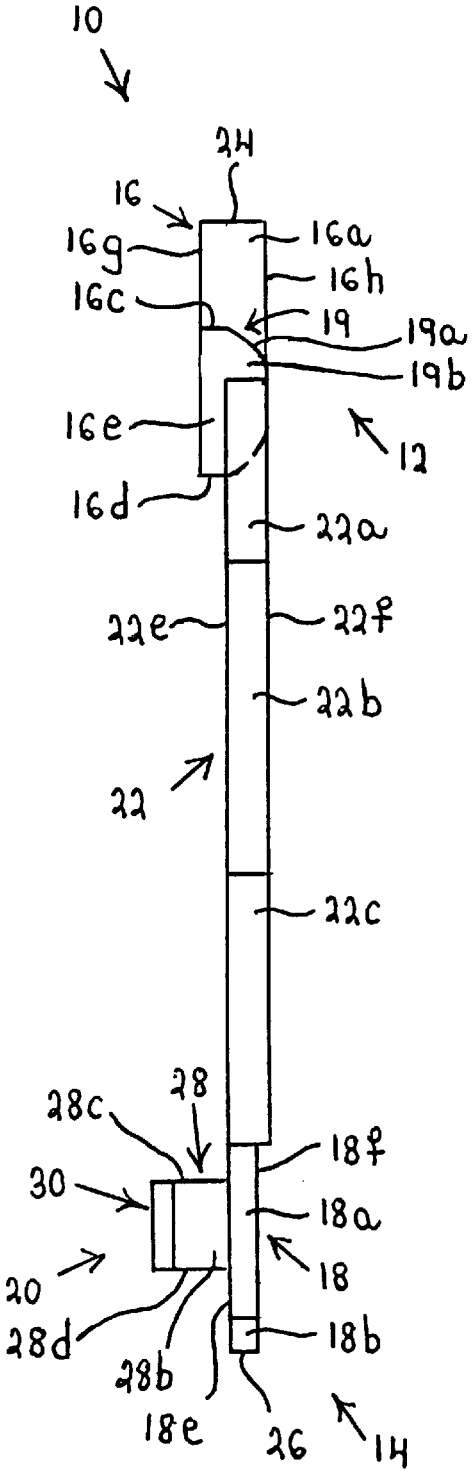
FIG. 3 is a front view of the spacer of FIG. 1.
Figure 4:
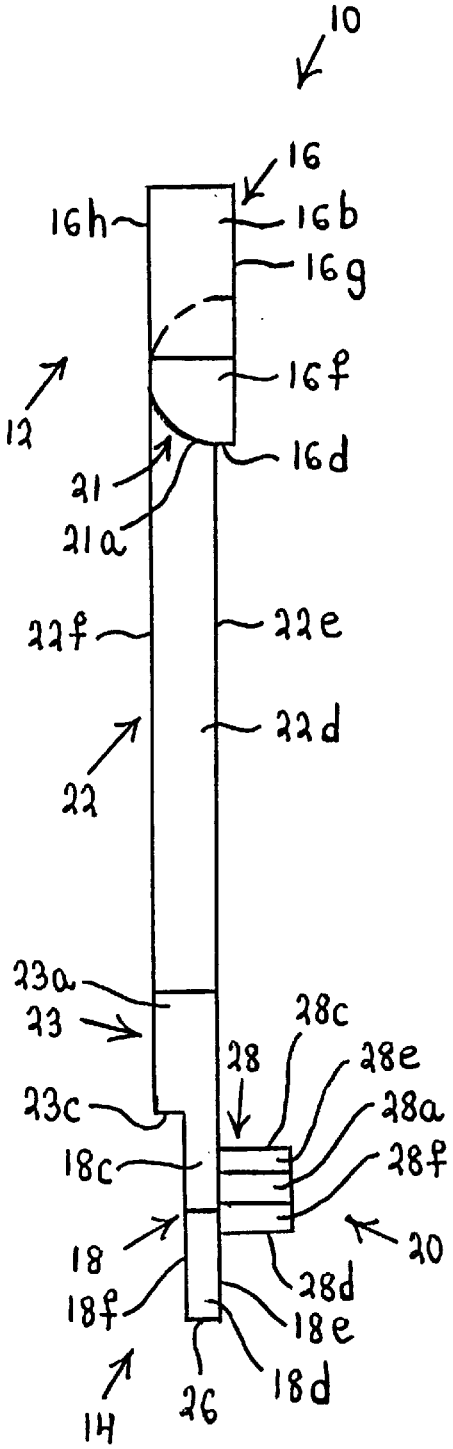
FIG. 4 is a rear view of the spacer of FIG. 1.
Figure 6:
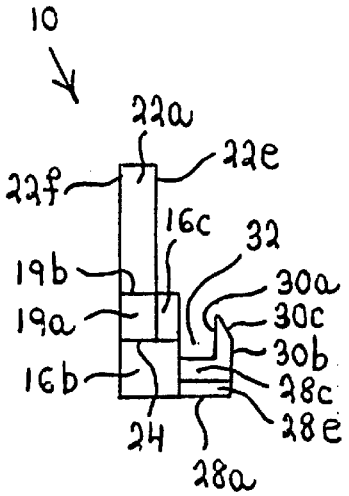
FIG. 6 is a view of the spacer of FIG. 1 as seen from the opposite end.
Figure 5:
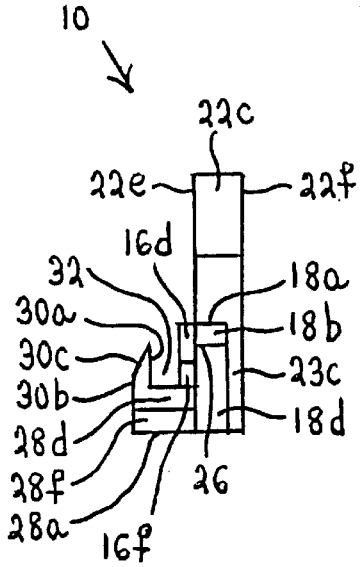
FIG. 5 is a view of the spacer of FIG. 1 as seen from one end.

Referring to FIGS. 1–6, the numeral 10 identifies a spacer according to the invention. The spacer 10 is electrically nonconductive and is designed to be mounted on an electrode which is immersed in an electrolytic bath, e.g., a bath for the electrowinning of copper. The spacer 10 functions to prevent contact between the electrode on which it is mounted and a neighboring electrode or between the electrode on which it is mounted and a wall of the vessel containing the electrolytic bath.

The spacer 10 is elongated, that is, the length of the spacer 10 is a multiple, or a multiple plus a fraction, of the maximum width of the spacer 10. The spacer 10 has a longitudinal end 12 which constitutes the upper end of the spacer 10 during use, and the spacer 10 has an opposite longitudinal end 14 which constitutes the lower end of the spacer 10 during use.

The upper end 12 of the spacer 10 includes a confining part 16 which resembles a jaw while the lower end 14 of the spacer 10 includes a leg 18 with a locking part 20. The spacer 10 further comprises a spacing part 22 which bridges the upper end 12 and the lower end 14 of the spacer 10 and hence is located between the confining part 16 and the locking part 20.

In use, the confining part 16 is located directly above, or almost directly above, the leg 18. The spacer 10 is then in an upright position.

The confining part 16 has a confining surface or surface portion 16*a* which is designed to face a side or major surface of the electrode on which the spacer 10 is mounted. At least the major portion of the confining surface 16*a* is flat. The confining part 16 further has a surface or surface portion 16*b* which faces away from the confining surface 16*a,* and the surface 16*b* is designed to serve as a slide and can be flat, concave or convex. If the sliding surface 16*b* is flat as shown, the sliding surface 16*b* defines an acute angle with the confining surface 16*a,* i.e., the sliding surface 16*b* and the confining surface 16*a* define an angle greater than 0 degrees and smaller than 90 degrees.

In the upright position of the spacer 10, the sliding surface 16*b* has a slope with respect to horizontal and vertical axes. The confining surface 16*a,* on the other hand, is perpendicular to a horizontal axis.

The confining surface 16*a* and the sliding surface 16*b* meet at an edge 24. The edge 24 is a knife-edge, or at least approximately a knife-edge, so that an electrode lowered onto the edge 24 will not hang up or become caught on the edge 24.

The confining surface 16*a* has an edge remote from the knife-edge 24, and the confining part 16 has an additional surface or surface portion 16*c* which intersects the confining surface 16*a* at such remote edge. The additional surface 16*c* constitutes an abutment surface for an electrode and runs transverse to the confining surface 16*a*. The abutment surface 16*c* is here flat and perpendicular or approximately perpendicular to the flat portion of the confining surface 16*a*.

The confining part 16 includes an element having a narrower section 19 and a wider section 21 each of which is in the form of a segment of a circle. The narrower section 19 is closer to the knife-edge 24 than is the wider section 21, and the narrower section 19 has a curved lateral face 19*a* which runs from the abutment surface 16*c* to the wider section 21. The curved lateral face 19*a* merges into a curved lateral face 21*a* of the wider section 21, and the lateral face 21*a* extends from the narrower section 19 to a second abutment surface or surface portion 16*d* of the confining part 19. The abutment surface 16*d* is farther from the knife-edge 24 than is the abutment surface 16*c* and lies between the ends of the spacing part 22. The abutment surface 16*d* is located opposite, and faces in the opposite direction from, the abutment surface 16*c*. In the illustrated embodiment, the abutment surface 16*d* is flat and parallel to the abutment surface 16*c*.

The narrower section 19 has a flat surface or surface portion 19*b* which runs from the spacing part 22 towards the knife-edge 24 while the confining part 16 has a flat strip-shaped surface or surface portion 16*e* which extends from the abutment surface 16*d* towards the abutment surface 16*c*. The strip-shaped surface 16*e* runs alongside the spacing part 22 and, at the end of the spacing part 22 nearest the knife-edge 24, has an extension adjacent to and coplanar with the flat surface 19*b*.

The confining part 16 has an additional surface or surface portion 16*f* which extends from the abutment surface 16*d* and the wider section 21 towards the sliding surface 16*b*. At least the major portion of the additional surface 16*f* is flat, and the flat portion of the additional surface 16*f* is inclined with respect to the sliding surface 16*b*. The sliding surface 16*b* and the flat portion of the additional surface 16*f* define an obtuse angle, that is, an angle greater than 90 degrees and smaller than 180 degrees. The sliding surface 16*b* and the additional surface 16*f* can meet at an edge or can be bridged by a curved surface portion of the confining part 16.

In the upright position of the spacer 10, the additional surface 16*f* has a slope relative to horizontal and vertical axes.

The confining part 16 has two flat side faces 16*g* and 16*h* which face in opposite directions and are parallel to one another. The side face 16*h* merges into the curved side face 21*a* forming part of the confining part 16.

The spacing part 22 is an elongated flat strip-like element or strip having a protrusion 23 at the end thereof remote from the confining part 16. When viewed from the side as in FIGS. 1 and 2, the spacing part 22 resembles a spine. The spacing part 22 has a surface or surface portion 22*a*, a surface or surface portion 22*b* and a surface or surface portion 22*c* each of which faces in the same general direction as the confining surface 16*a*. The spacing surfaces 22*a*, 22*b*, 22*c* are adapted to face either a major surface of an electrode located next to the one on which the spacer 10 is mounted or a wall of a vessel receiving the spacer 10.

The spacing surface 22*a* extends from the confining part 16 partway to the leg 18 while the spacing surface 22*c* extends from the leg 18 partway to the confining part 16. The spacing surfaces 22*a*, 22*c* terminate short of one another and are connected to each other by the spacing surface 22*b*. The spacing surface 22*b* constitutes an abutment surface which, upon lateral movement of the electrode on which the spacer 10 is mounted, may come into contact with a neighboring electrode or with a wall of the vessel containing the spacer 10.

In the upright position of the spacer 10, the spacing surfaces 22*a*, 22*c* have a slope with respect to horizontal and vertical axes. The spacing surface 22*a* may be flat, concave or convex and the same holds true for the spacing surface 22*c*. The spacing surface 22*a* is here convex while the spacing surface 22*c* is flat. The spacing surface 22*b* is preferably flat as shown and, in such an event, is perpendicular to a horizontal axis in the upright position of the spacer 10.

The spacing part 22 has an additional surface or surface portion 22*d* which faces in the opposite direction from the spacing surfaces 22*a*, 22*b*, 22*c*. The additional surface 22*d*, which is preferably flat and parallel to the spacing surface 22*b*, is adapted to face a side or major surface of an electrode on which the spacer 10 is mounted.

The protrusion 23 of the spacing part 22 is located on the same side of the spacing part 22 as the additional surface 22*d* and has a surface or surface portion 23*a* which faces in the same direction as the additional surface 22*d*. The protrusion 23 further has a surface or surface portion 23*b* which faces the upper end 12 of the spacer 10 and an end surface or surface portion 23*c* which faces away from the upper end 12. Each of the surfaces 23*a*, 23*b*, 23*c* is flat, and the surfaces 23*b*, 23*c* are parallel to one another. The surface 23*a* can be connected to the adjoining surfaces 23*b*, 23*c* by curved surface portions. The surface 23*b*, which intersects the additional surface 22*d* and can be perpendicular thereto, constitutes an abutment surface for an electrode on which the spacer 10 is mounted.

In the upright position of the spacer 10, the surface 23*a* is perpendicular to a horizontal axis while the surfaces 23*b*, 23*c* are parallel to such axis.

The spacing part 22 is laterally bounded by two flat side faces 22*e* and 22*f*. The side faces 22*e*, 22*f* face in opposite directions and are parallel to one another. Furthermore, the side faces 22*e*, 22*f* are parallel to or coplanar with the flat portions of the side faces 16*g*, 16*h*. In the illustrated embodiment, the side face 22*e* is parallel to the flat portion of the side face 16*g* while the side face 22*f* is coplanar with the flat portion of the side face 16*h*.

The thickness of the spacing part 22 is less than that of the confining part 16, and the confining part 16 accordingly projects laterally of the spacing part 22. Since the side face 22*f* of the spacing part 22 is coplanar with the flat portion of the side face 16*h* of the confining part 16, the confining part 16 projects laterally beyond the side face 22*e* of the spacing part 22.

The leg 18 of the spacer 10 extends from the end surface 23*c* of the protrusion 23 in a direction away from the upper end 12 of the spacer 10. The leg 18 is a flat strip-like element or strip having a surface or surface portion 18*a* and a surface or surface portion 18*b* each of which faces in the same general direction as the confining surface 16*a*. The leg 18 further has a surface or surface portion 18*c* and a surface or surface portion 18*d* each of which faces in the same general direction as the sliding surface 16*b*. The surfaces 18*b* and 18*d* are more remote from the upper end 12 of the spacer 10 than the respective surfaces 18*a* and 18*c*, and the surfaces 18*b*, 18*d* converge to an edge 26. The surfaces 18*a*, 18*b*, 18*c*, 18*d* are preferably flat as shown and, in the upright position of the spacer 10, the surfaces 18*a*, 18*c* are perpendicular to a horizontal axis while the surfaces 18*b*, 18*d* are inclined to horizontal and vertical axes.

The leg 18 is laterally bounded by two flat side faces 18*e* and 18*f*. The side faces 18*e*, 18*f* face in opposite directions and are parallel to one another. Moreover, the side faces 18*e*, 18*f* are parallel to or coplanar with the side faces 22*e*, 22*f*. In the present embodiment, the side face 18*f* is parallel to the side face 22*f* whereas the side face 18*e* is coplanar with the side face 22*e*.

The thickness of the leg 18 is less than that of the spacing part 22 so that the spacing part 22 projects laterally of the leg 18. Since the side face 18*e* of the leg 18 is coplanar with the side face 22*e* of the spacing part 22, the spacing part 22 projects laterally beyond the side face 18*f* of the leg 18.

The locking part 20 is mounted on the side face 18*e* of the leg 18. The locking part 20 is L-shaped and includes two arms 28 and 30. The arm 28 extends at a right angle from the side face 18*e* of the leg 18 and has two flat parallel surfaces or surface portions 28*a* and 28*b*. The surface 28*a* is coplanar or approximately coplanar with the surface 18*c* of the leg 18 while the surface 28*b* is located between the surfaces 18*a*, 18*c* of the leg 18. The arm 28 further has two flat parallel end faces 28*c* and 28*d* which are located in planes perpendicular to the planes of the surfaces 28*a*, 28*b*. As illustrated, the end face 28*c* and the surface 28*a* of the arm 28 may be connected to one another by a curved surface or surface portion 28*e* while the end face 28*d* and the surface 28*a* may be connected to one another by a curved surface or surface portion 28*f*.

The surface 28*b* of the arm 28 has an edge remote from the leg 18 and parallel to the side face 18*e* of the leg 18. The arm 30 of the locking part 20 projects from this edge beyond the surface 28*b*, and the arm 30 has a flat side face 30*a* which faces and is parallel to the side face 18*e*. The side face 30*a*, which is spaced from the side face 18*e*, is perpendicular to the surface 28*b*. The arm 30 further has a flat side face 30*b* which faces away from and is parallel to the side face 30*a*, and the side face 30*b* terminates at a smaller distance from the surface 28*b* than does the side face 30*a*. The side faces 30*a,* 30*b* are bridged by a flat face 30*c* which is inclined to the side faces 30*a,* 30*b*.

The locking part 20 and the leg 18 cooperate to define a space or locking channel 32 bounded by the side face 18*e* of the leg 18, the side face 30*a* of the arm 30 and the surface 28*b* of the arm 28. The width of the locking channel 32, that is, the distance between the side face 18*e* and the side face 30*a,* is equal to or greater than the thickness of the leg 18.

The confining part 16 and the spacing part 22 cooperate to define a cavity or recess 34 in the spacer 10. The recess 34 is bounded by the surface 22*d* of the spacing part 22, the surface 23*b* of the protrusion 23 and the curved surface 21*a* of the confining part 16. The side of the recess 34 opposite the surface 22*d* is open, and the recess 34 serves to accommodate part of an electrode on which the spacer 10 is mounted.

Figure 7:
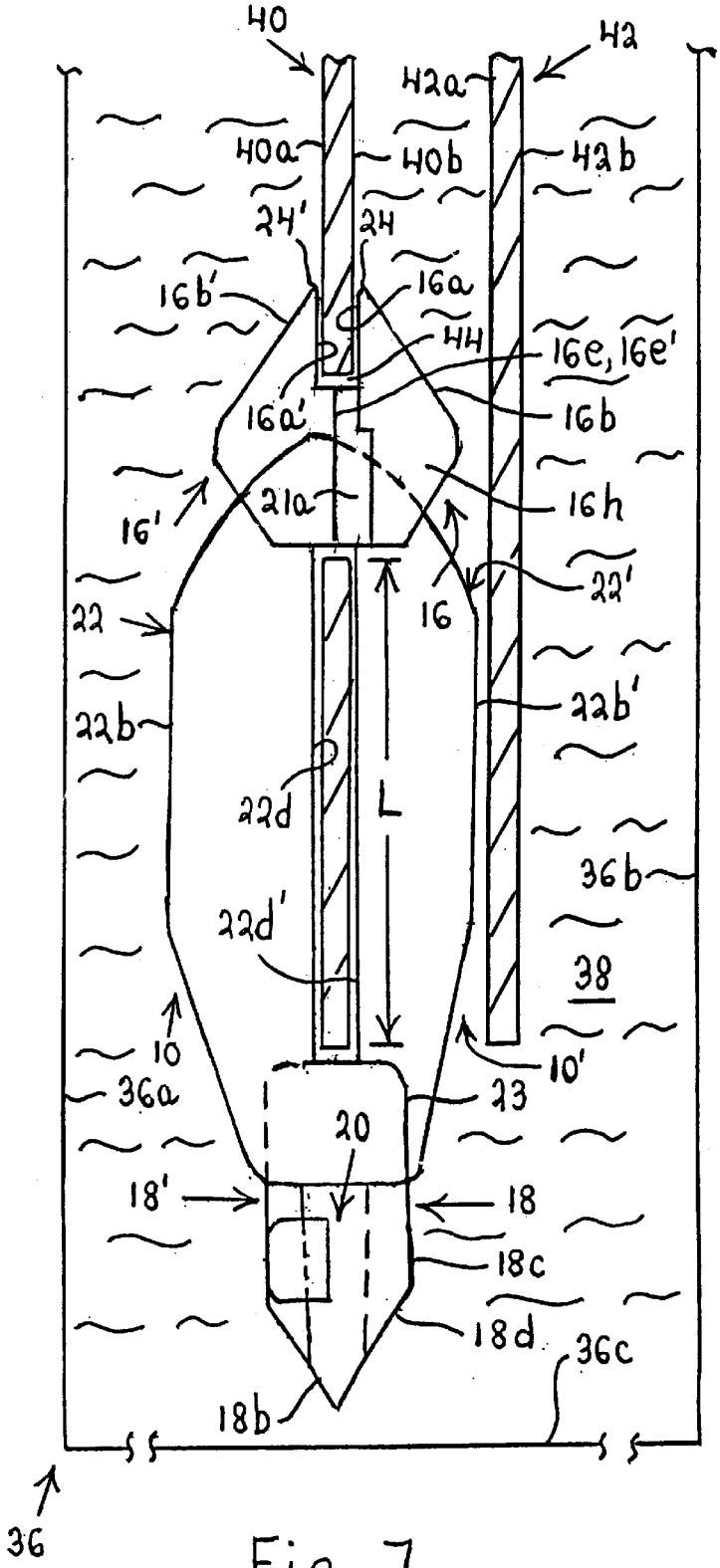
FIG. 7 is a fragmentary view showing the spacer of FIG. 1 and a second spacer mounted on an electrode.

FIG. 7 schematically illustrates an apparatus for the electrowinning of copper. The electrowinning apparatus includes a vessel or tank 36 having opposed side walls 36*a* and 36*b* and a bottom wall 36*c*. The vessel 36 contains an electrolytic bath or electrolyte 38, and a series of electrodes is suspended in the bath 38. The electrodes are arranged side-by-side with anodes and cathodes alternating, and two of the electrodes are shown in FIG. 7. These are an anode 40 having opposite sides or major surfaces 40*a* and 40*b* and a cathode 42 having opposite sides or major surfaces 42*a* and 42*b*.

As illustrated in FIG. 7, the spacer 10 is designed to cooperate with a separate but identical second spacer 10' to form a spacing arrangement for the electrodes in the electrolytic bath 38. In use, a spacing arrangement 10, 10' is mounted on each anode. To this end, every one of the anodes in the electrolytic bath 38 is provided with an opening near the lower end thereof as shown at 44 for the anode 40.

The operation of the spacing arrangement 10, 10' is described below with reference to FIG. 7 as well as FIGS. 1–6. In the following description, the same reference characters as for the spacer 10, but with primes, will be used to denote corresponding portions of the spacer 10'. Since the spacer 10' is identical to the spacer 10, each portion of the spacer 10 has a counterpart in the spacer 101.

As indicated in FIG. 7, the distance from the bottom of the anode 40 to the opening 44 is L. The length of the recess 34 of the spacer 10, that is, the distance from the surface 23*b* of the protrusion 23 to the surfaces 16*d,* 21*a* of the confining part 16, is at least slightly greater than the distance L. The same is true for the recess of the spacer 10' corresponding to the recess 34.

Prior to insertion of the anode 40 in the electrolytic bath 38, the confining part 16 of the spacer 10 is passed through the opening 44 in the anode 40 from the major surface 40*a* of the anode 40. As a result, the confining part 16 is located adjacent to the major surface 40*b* of the anode 40 while the spacing part 22 is located adjacent to the major surface 40*a* of the anode 40.

Similarly, the confining part 16' of the spacer 10' is passed through the opening 44 from the major surface 40*b* of the anode 40. Accordingly, the confining part 16' is located adjacent to the major surface 40*a* of the anode 40 whereas the spacing part 22' is located adjacent to the major surface 40*b* of the anode 40.

The spacer 10 is oriented with the confining surface 16*a* of the confining part 16 and the surface 22*d* of the spacing part 22 facing the anode 40. Furthermore, the spacer 10 is positioned with the leg 18 adjacent to the bottom of the anode 40.

Likewise, the spacer 10' is oriented with the confining surface 16*a'* of the confining part 16' and the surface 22*d'* of the spacing part 22 facing the anode 40. In addition, the spacer 10' is positioned with the leg 18' adjacent to the bottom of the anode 40.

Since the distance L from the opening 44 in the anode 40 to the bottom of the anode 40 is less than the lengths of the recess 34 of the spacer 10 and the corresponding recess of the spacer 10', the portion of the anode 40 between the opening 44 and the bottom of the anode 40 can enter the these recesses. The spacers 10, 10' are adjusted so that the strip-shaped surface 16*e* of the spacer 10 contacts the strip-shaped surface 16*e'* of the spacer 10'. Furthermore, the side face 18*e* of the spacer 10 is placed face-to-face with the corresponding side face of the spacer 101. The leg 18' of the spacer 10' can then be slid into the locking channel 32 of the spacer 10 and the leg 18 of the spacer 10 into the locking channel of the spacer 10'.

As seen in FIG. 7, when the strip-shaped surfaces 16*e,* 16*e'* contact one another and the legs 18, 18' are received in the respective locking channels, the portion of the anode 40 between the opening 44 and the bottom of the anode 40 is accommodated in a space defined by the recess 34 of the spacer 10 and the corresponding recess of the spacer 10'. Moreover, a portion of the anode 40 immediately above the opening 44 is confined between the confining surfaces 16*a,* 16*a'* of the confining parts 16, 16'. The anode 40 is now ready to be lowered into the electrolytic bath 38.

FIG. 7 shows that the spacers 10, 10' are in their upright positions when the anode 40 is immersed in the electrolytic bath 38. Thus, the confining parts 16, 16' are located above the spacing parts 22, 22' and the feet 18, 18', and the sliding surfaces 16*b,* 16*b'*, as well as the knife-edges 24, 24', face upwards. The spacing surface 22*b'* of the spacer 10' faces an adjoining major surface of the cathode 42 located to the right of the anode 40 as seen in FIG. 7. On the other hand, the spacing surface 22*b* of the spacer 10 faces the side wall 36*a* of the vessel 36 or an adjoining major surface of a cathode located to the left of the anode 40 as seen in FIG. 7.

In the electrowinning of copper, layers of copper build up on the cathodes and must be removed periodically. When a layer of copper is to be removed from a cathode, the cathode is lifted out of the vessel 36 and replaced by another cathode.

Assuming that the cathode 42 has been lifted out of the vessel 36 in order to remove a layer of copper from it, a fresh cathode is lowered into the space within the vessel 36 vacated by the cathode 42. Since the anodes and cathodes are located close to one another, there is a good likelihood that the bottom edge of the fresh cathode will come to rest on the confining part 16 of the spacer 10, or the confining part of the spacer on the anode to the right of the anode 40, as the fresh cathode is being inserted in the vessel 36. With a button-like spacer of the prior art, the cathode can become hung up on the spacer and the weight of the cathode can cause the spacer to shear. In contrast, if the cathode should come into contact with the confining part 16 of the spacer 10, the upwardly facing knife-edge 24 provides no opportunity for the cathode to become hung up. Moreover, the upwardly facing sliding surface 16*b,* which is sloped to facilitate sliding of the cathode, allows the cathode to easily slide off the confining part 16 and into its assigned space.

In addition, the spacer 10 reduces shadowing on the cathode 42. This derives from the fact that the spacer 10 is elongated, that is, the length of the spacer 10 is a multiple, or a multiple plus a fraction, of the maximum width of the spacer 10. Thus, it has been found that shadowing decreases with an increase in the ratio of the length of a spacer to the area of the spacer which confronts a cathode. This ratio is relatively large in an elongated element such as the spacer 10.

The spacing arrangement 10, 10' is also relatively inexpensive to manufacture since the spacers 10 and 10' are identical.

Furthermore, since the spacers 10, 10' are designed to be mounted in an opening of an electrode, and can thus be mounted on the electrode at a location below the upper end of the electrode, the lengths of the spacers 10, 10' may be less than the height of the electrode. The spacers 10, 10' are then shorter and simpler to handle than a spacer of the type which is supported on the upper end of an electrode and extends to the bottom of the electrode.

Moreover, the spacers 10, 10' are designed to cooperate in such a manner that the spacers 10, 10' function as a single spacer. However, since the spacers 10, 10' are discrete, each of the spacers 10, 10' is smaller than an equivalent single spacer thereby making the spacers 10, 10' easier to manipulate than such a single spacer.

When the spacers 10, 10' are assembled as in FIG. 7 to form the spacing arrangement 10, 10', it is a simple matter to separate the spacers 10, 10'. Thus, it is only necessary to slide the legs 18, 18' out of the respective locking channels.

Various modifications are possible within the meaning and range of equivalence of the appended claims.

I claim:

1. An arrangement for spacing electrodes in an electrolytic bath comprising:

at least one electrode having a first side, an opposite second side and an opening extending between said first side and said second side; and at least one spacer passing through said opening, said at least one spacer having an upper end provided with a confining part which is at least partially disposed on said first side of said at it least one electrode, and said at least one spacer further including a spacing part which is at least partially disposed on said second side of said at least one electrode to separate said at least one electrode from a neighboring electrode, said confining part having a first surface portion which faces said first side of said at least one electrode, an upward facing second surface portion and an upward facing edge which bridges said first surface portion and said second surface portion, said edge at least approximating a knife-edge, and said second surface portion having a slope to permit sliding of an electrode along said second surface portion.

2. The arrangement of claim 1, wherein said spacing part is substantially flat and strip-like.

3. The arrangement of claim 1, wherein said spacing part is provided with an upward facing surface portion having a slope to permit sliding of an electrode along said upward facing surface portion of said spacing part.

4. The arrangement of claim 1, wherein said at least one spacer is provided with a cavity which accommodates a portion of said at least one electrode, said cavity being bounded on one side by a lateral surface which faces said second side of said at least one electrode, and said cavity being open on an additional side directly opposite said one side.

5. The arrangement of claim 4, wherein said at least one electrode has a downward facing surface portion and said cavity is additionally bounded by an abutment surface which is transverse to said lateral surface, said abutment surface being located beneath and confronting said downward facing surface portion.

6. The arrangement of claim 5, wherein said at least one electrode has a bottom edge which includes said downward facing surface portion.

7. The arrangement of claim 1, wherein said opening is bounded by a peripheral surface having a downward facing surface portion, said confining part comprising an abutment surface which is transverse to said first surface portion, and said abutment surface being located beneath and confronting said downward facing surface portion.

8. The arrangement of claim 1, further comprising an additional spacer which passes through said opening, said at least one spacer defining a first space which receives a portion of said additional spacer, and said additional spacer defining a second space which receives a portion of said at least one spacer.

9. The arrangement of claim 8, wherein said at least one spacer has a lower end and said first space is located at said lower end.

10. The arrangement of claim 3, wherein said at least one spacer is provided with an L-shaped part which partially bounds said first space.

11. The arrangement of claim 10, wherein said L-shaped part is of one piece with said at least one spacer.

12. The arrangement of claim 8, wherein said at least one spacer and said additional spacer are substantially identical.

13. The arrangement of claim 1, further comprising an additional spacer which passes through said opening, said additional spacer having an additional upper end provided with an additional confining part which is at least partially disposed on said second side of said at least one electrode, and said additional spacer further including an additional spacing part which is at least partially disposed on said first side of said at least one electrode to separate said at least one electrode from a neighboring electrode, said additional confining part having an additional first surface portion which faces said second side of said at least one electrode, an upward facing additional second surface portion and an upward facing additional edge which bridges said additional first surface portion and said additional second surface portion, said additional edge at least approximating a knife-edge, and said additional second surface portion having a slope to permit sliding of an electrode along said additional second surface portion.

14. An arrangement for spacing electrodes in an electrolytic bath comprising:

a first spacer adapted to be mounted on a selected electrode of a plurality of electrodes, said first spacer defining a first space; and a second spacer adapted to be mounted on the selected electrode, said second spacer being discrete from said first spacer and defining a second space, and said first spacer and said second spacer being arranged with a portion of said first spacer in said second space and with a portion of said second spacer in said first space.

15. The arrangement of claim 14, wherein said first spacer has at least one end and said at least one end is provided with a confining part for the selected electrode, said at least one end being adapted to face upward when said first spacer is mounted on the selected electrode, and said confining part having a first surface portion adapted to face one major surface of the selected electrode, a second surface portion adapted to face upward when said first spacer is mounted on the selected electrode and an edge which bridges said first surface portion and said second surface portion, said edge at least approximating a knife-edge, and said second surface portion having a slope to permit sliding of an electrode along said second surface portion.

16. The arrangement of claim 14, wherein said second spacer has an additional end and said additional end is provided with an additional confining part for the selected electrode, said additional end being adapted to face upward when said second spacer is mounted on the selected electrode, and said additional confining part having an additional first surface portion adapted to face an additional major surface of the selected electrode, an additional second surface portion adapted to face upward when said second spacer is mounted on the selected electrode and an additional edge which bridges said additional first surface portion and said additional second surface portion, said additional edge at least approximating a knife-edge, and said additional second surface portion having a slope to permit sliding of an electrode along said additional second surface portion.

17. The arrangement of claim 15, wherein said first spacer has an additional end and said first space is located at said additional end.

18. The arrangement of claim 15, wherein said confining part comprises an abutment surface for the selected electrode, said abutment surface being transverse to said first surface portion.

19. The arrangement of claim 14, wherein said first spacer comprises a substantially flat, strip-like spacing part for separating the selected electrode from a neighboring electrode.

20. The arrangement of claim 14, wherein said first spacer comprises a spacing part for separating the selected electrode from a neighboring electrode, said spacing part having a surface portion which is adapted to face upward when said first spacer is mounted on the selected electrode, and said surface portion of said spacing part having a slope to permit sliding of an electrode along said surface portion of said spacing part.

21. The arrangement of claim 14, wherein said first spacer is provided with a cavity for accommodating a portion of the selected electrode, said cavity being bounded on a first side by a lateral surface adapted to face a major surface of the selected electrode, and said cavity being open on a second side directly opposite said first side.

22. The arrangement of claim 21, wherein said cavity is additionally bounded by an abutment surface for the selected electrode, said abutment surface being transverse to said lateral surface.

23. The arrangement of claim 14, wherein said first spacer is provided with an L-shaped part which partially bounds said first space.

24. The arrangement of claim 23, wherein said L-shaped part is of one piece with said first spacer.

25. The arrangement of claim 14, wherein said first spacer and said second spacer are substantially identical.

26. A method of arranging for the spacing of electrodes in an electrolytic bath comprising the steps of:

providing at least one electrode having a first side, an opposite second side and an opening extending between said first side and said second side;

providing a spacer having a spacing part and an end which includes a confining part, said confining part having a first surface portion, a second surface portion and an edge which bridges said first surface portion and said second surface portion, said edge at least approximating a knife-edge, and said second surface portion having a slope;

passing said spacer through said opening so that said confining part is at least partially disposed on said first side of said at least one electrode and said spacing part is at least partially disposed on said second side of said at least one electrode;

positioning said spacer with said first surface portion facing said first side of said at least one electrode and with said second surface portion and said edge facing upward;

immersing said at least one electrode and said spacer in said electrolytic bath; and immersing an additional electrode in said electrolytic bath such that said spacing part is disposed between said at least one electrode and said additional electrode.

27. A method of arranging for the spacing of electrodes in an electrolytic bath comprising the steps of:

providing a first spacer which defines a first space and is adapted to be mounted on a selected electrode of a plurality of electrodes;

providing a second spacer which defines a second space and is adapted to be mounted on the selected electrode, said second spacer being discrete from said first spacer; and positioning said first spacer and said second spacer with a portion of said first spacer in said second space and with a portion of said second spacer in said first space.

* * * * *

UNITED STATES PATENT AND TRADEMARK OFFICE

CERTIFICATE OF CORRECTION

PATENT NO. : 6,483,036 B1
DATED : November 19, 2002
INVENTOR(S) : Manuel G. Santoyo It is certified that error appears in the above-identified patent and that said Letters Patent is hereby corrected as shown below:

Column 10,
Line 21, replace "claim 3" with -- claim 8 --.

Signed and Sealed this

Eighth Day of April, 2003

JAMES E. ROGAN
*Director of the United States Patent and Trademark Office*